US005997453A

United States Patent [19]

Weidhaas, Sr. et al.

[11] Patent Number: 5,997,453

[45] Date of Patent: Dec. 7, 1999

[54] CLAMSHELL PRESS HAVING SHIFTABLE HONEYCOMB CHASE

[75] Inventors: Robert G. Weidhaas, Sr., Overland Park; Matthew S. Amburg, Edwardsville; Robert G. Weidhaas, Jr., Lenexa, all of Kans.

[73] Assignee: Preco Industries, Inc., Lenexa, Kans.

[21] Appl. No.: 09/060,484

[22] Filed: Apr. 15, 1998

[51] Int. Cl.[6] ..... B23Q 3/155

[52] U.S. Cl. ..... 483/28; 83/566; 100/918

[58] Field of Search ..... 483/28, 29; 100/918, 100/224, 233; 83/563, 564, 566; 72/446, 442

[56] References Cited

U.S. PATENT DOCUMENTS

| | | | |
|---|---|---|---|
| 3,848,495 | 11/1974 | Youra | 100/918 X |
| 3,926,032 | 12/1975 | Brooks et al. | 100/918 X |
| 3,935,811 | 2/1976 | Lenz et al. | 100/918 X |
| 5,072,507 | 12/1991 | Meeks | 483/28 X |
| 5,114,330 | 5/1992 | Nielson | 100/918 X |
| 5,152,204 | 10/1992 | Trevizo | 83/566 X |
| 5,317,892 | 6/1994 | Medici | 72/448 |
| 5,582,062 | 12/1996 | Sommer | 483/28 |
| 5,827,159 | 10/1998 | Adachi | 83/353 X |

FOREIGN PATENT DOCUMENTS

| | | | |
|---|---|---|---|
| 248318 | 8/1987 | Germany | 100/918 |
| 620406 | 8/1978 | U.S.S.R. | 100/918 |
| 1780903 | 12/1992 | U.S.S.R. | 483/28 |

OTHER PUBLICATIONS

Zenari s.n.c Engineering Brochure; "Mettifoglio".

Thomson National Press Company Flyer; "Printers Connection", Aug. 1991, No. 1.

Preco Industries Brochure; "Preco Automatic Sheet Feeder".

Industrial Tool & Machine Service Company Brochure; "AF241 Automatic Sheet Feeder".

Industrial Tool & Machine Service Company Brochure; "Die Cutting—Kiss Cutting—Foil Stamping Mechanical Acting Platen Press".

*Primary Examiner*—William Briggs

*Attorney, Agent, or Firm*—Hovey, Williams, Timmons & Collins

[57] ABSTRACT

A preferred clamshell press (10) includes a changeover apparatus (12) for shifting the tool support chase (22) between an operating position and a shifted position in which the chase (22) is positioned for facilitating tool changing thereon while remaining coupled with the machine body (14). The changeover apparatus (12) includes a tracking assembly (26) having rollers (40) received in guide tracks (32) in the side edges of the chase (22) for guiding the chase (22) during shifting, and an actuator (28) using hydraulic cylinders (42, 44) to shift the chase (22). The apparatus (12) further includes registration slots (62, 66) and corresponding registration tabs (60, 64) for ensuring registration between the chase (22) and the machine body (14) in the operating position, and a locking mechanism (56) for locking the chase (22) in the operating position.

16 Claims, 6 Drawing Sheets

CLAMSHELL PRESS HAVING SHIFTABLE HONEYCOMB CHASE

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of presses such as platen, converting, die-cutting, foil stamping and embossing presses. In particular, the invention is concerned with a changeover apparatus for shifting the tool support chase between an operating position for operations and a shifted position in which the chase is positioned for facilitating tool changing thereon while remaining coupled with the machine body.

2. Description of the Prior Art

Prior art clamshell presses include a honeycomb plate or chase to which tooling is mounted for die-cutting operations. The chase can weigh 150 pounds or more and is sometimes heated. The configuration of a clamshell press is such that the chase may require removal in order to change the tooling and then replaced and aligned such tool. Because of the weight of the chase and its temperature, removal may require use of a hoist and repositioning sometimes requires two people. The retooling process can take upwards of an hour during which time the press is idle.

SUMMARY OF THE INVENTION

The present invention solves the prior art problems discussed above and provides a distinct advance in the state of the art. More particularly, the press and changeover apparatus hereof allows for rapid and efficient retooling, positioning and registering of a tool-supporting chase.

The preferred press includes a changeover apparatus for shifting the tool support chase between an operating position and a shifted position in which the chase is shifted into a position facilitating tool changing thereon while remaining coupled with the machine body. The preferred changeover apparatus includes a tracking assembly having rollers received in guide tracks in the side edges of the chase for guiding the chase during shifting, and an actuator using hydraulic cylinders shifts the chase.

The preferred changeover apparatus also includes a holding assembly for positioning and holding the chase and machine body in registration in the operating position. In preferred forms, the holding assembly includes registration slots and corresponding registration tabs for ensuring registration between the chase and the machine body in the operating position, and further includes a locking mechanism for locking the chase in the operating position. Other preferred aspects of the present invention are disclosed herein.

DETAILED DESCRIPTION OF THE PREFERRED EMBODIMENT

Figure 1:
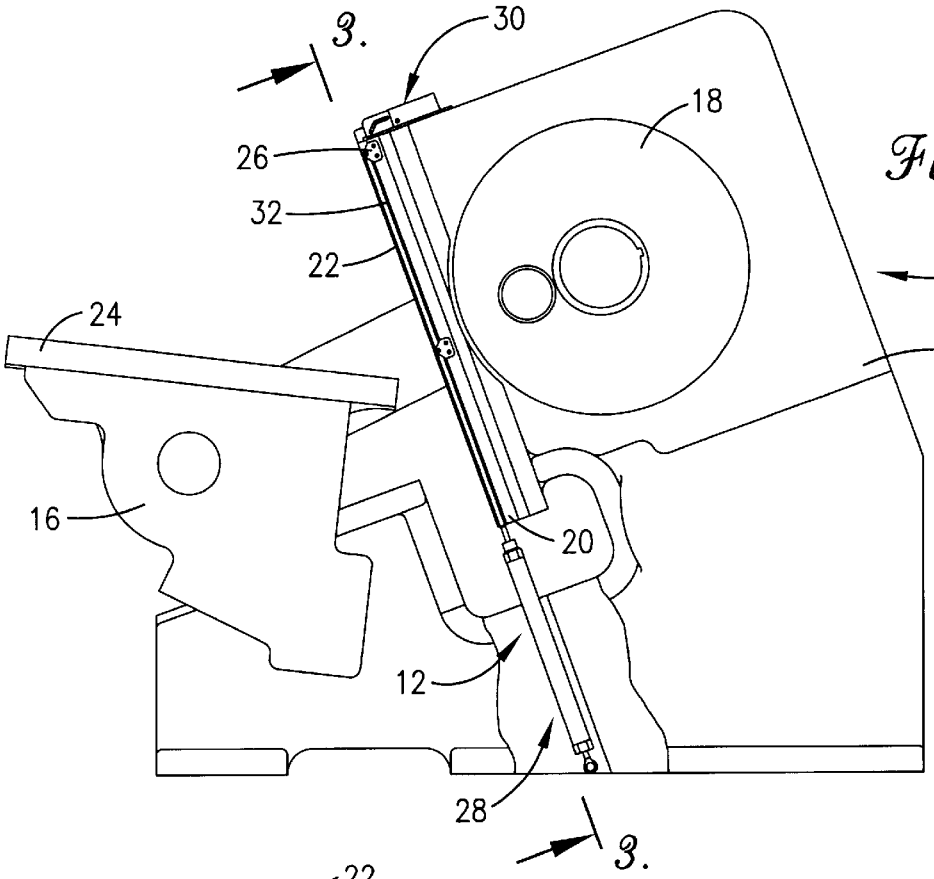
FIG. 1 is a side elevational view of the preferred press of the present invention showing the chase in the operating position.
Figure 2:
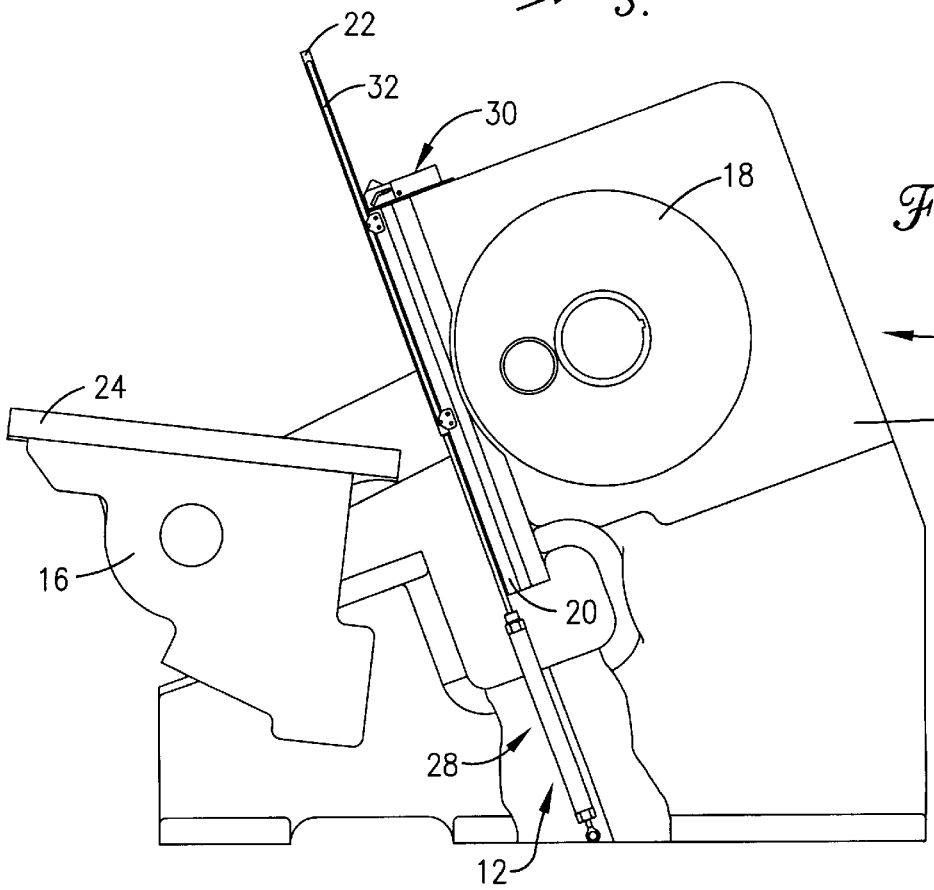
FIG. 2 is a view similar to FIG. 1 but showing the chase in the shifted position.

The drawing figures illustrate a preferred press 10 in accordance with the present invention incorporating the preferred changeover apparatus 12 thereof. Referring to FIGS. 1 and 2, press 10 is conventional in nature such as a platen, converting, die-cutting, foil stamping, or clamshell press and broadly includes press or machine body 14, die jaw 16 and toggle drive 18.

Machine body 14 includes platen 20 positioned for supporting honeycomb plate or chase 22. As used herein, chase 22 can also include a die mounting plate or PMC base to which selected tools are mounted. These selected tools can include dies, converting tools, stamping tools, embossing tools and the like.

A conventional toggle link (not shown for clarity of illustration) connects drive 18 with jaw 18 in order to rotate jaw 16 and thereby shift die plate 24 into engagement with chase 22 for die cutting a substrate therebetween. Further rotation of drive 18 toggles jaw 16 and plate 24 away from chase 22 to the open position shown in FIGS. 1 and 2.

Changeover apparatus 12 shiftably couples chase 22 with machine body 14. Apparatus 12 broadly includes track assembly 26, actuator 28 and holding assembly 30.

Figure 6:
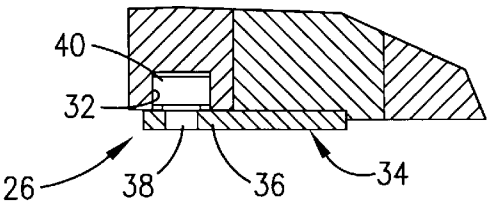
FIG. 6 is a partial, sectional view taken along line 6—6 of FIG. 5.
Figure 5:
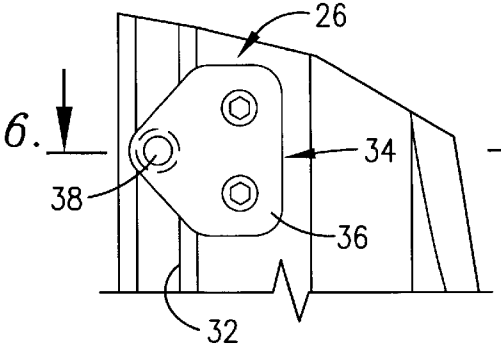
FIG. 5 is a partial, elevational view taken along line 5—5 of FIG. 4.
Figure 10:
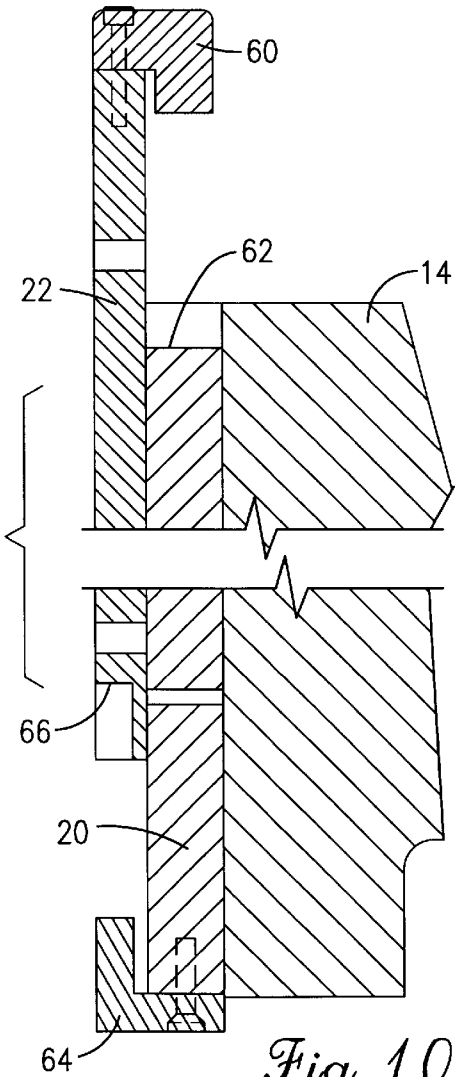
FIG. 10 is a partial sectional view of the chase and adjacent portions of the press of FIG. 1 showing the chase in the shifted position.
Figure 8:
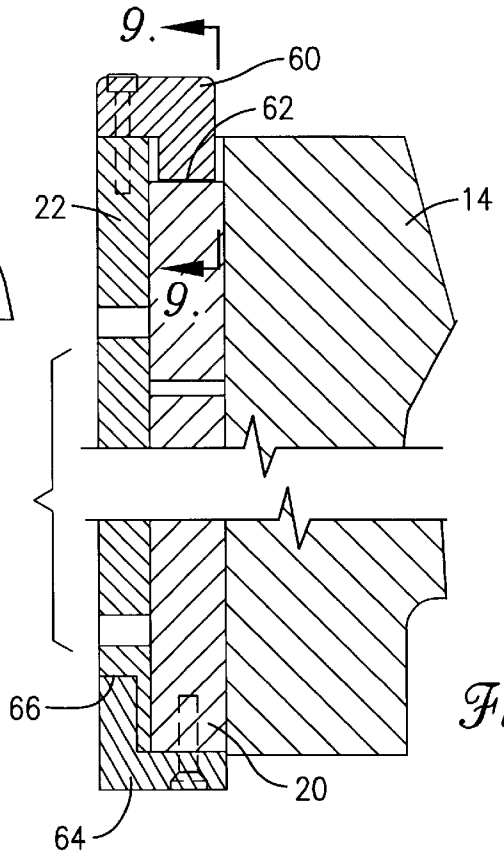
FIG. 8 is a partial sectional view taken along line 8—8 of FIG. 3.

As shown in FIGS. 1–2 and 5–10, track assembly 26 includes two guide slots or tracks 32 defined in the opposed side edges of chase 22 and further includes four, guide roller assemblies 34. Each assembly 34 includes a mounting plate 36, a roller shaft 38 extending from plate 36, and a roller 40 coupled with the distal end of shaft 38. As best shown in FIGS. 5 and 6, each mounting plate 36 is attached to machine body 14 adjacent chase 22 and positioned so that roller 40 is received in a respective guide track 32.

Two assemblies 34 are positioned on each side of chase 22 for shiftably coupling chase 22 with machine body 14 for selective shifting of chase 22 relative to machine body 14 between a operating position (FIG. 1) and a shifted position (FIG. 2). In the shifting position, chase 22 is accessible for tool changeover, adjustments and registration positioning.

In the operating position of FIG. 1, chase 22 is shifted downwardly and in position for engaging platen 20 of jaw 16 with a substrate therebetween during a die-cutting operation. In the shifted position of FIG. 2, chase 22 is shifted upwardly and exposed for convenient and efficient changeover by one person of the tooling attached to the exposed face of chase 22.

Figure 3:
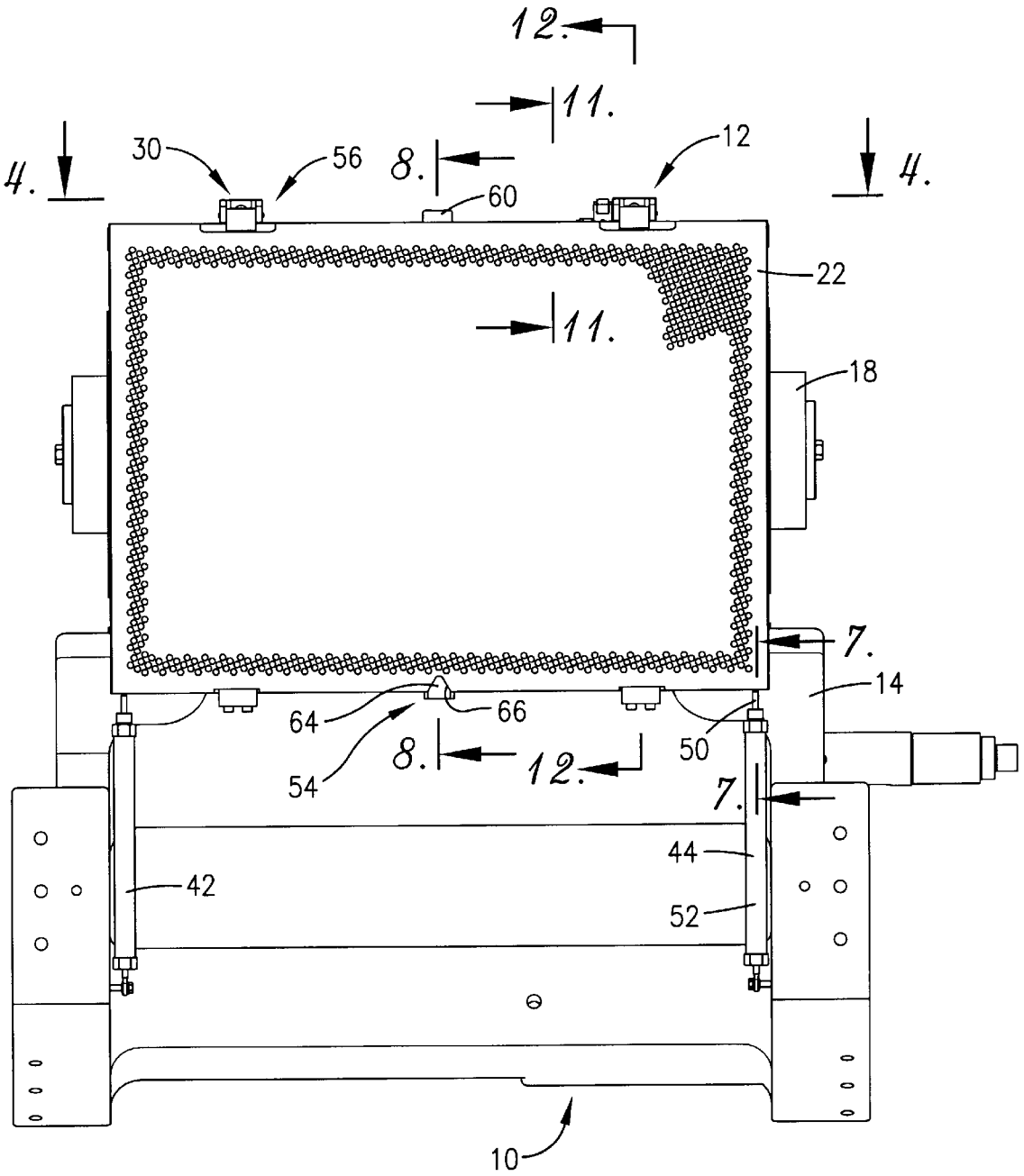
FIG. 3 is a view taken along line 3—3 of FIG. 1.
Figure 4:
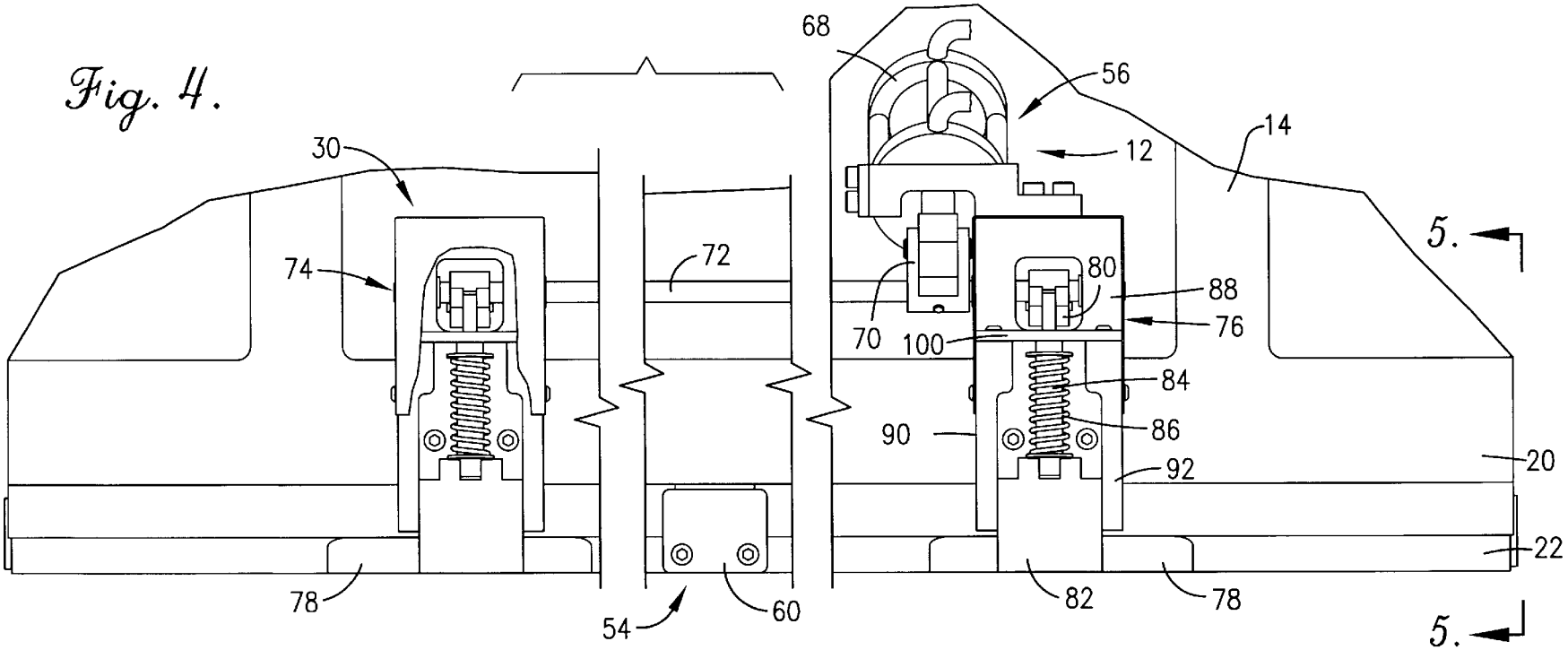
FIG. 4 is a partial, fragmentary, top plan view taken along line 4—4 of FIG. 3.
Figure 7:
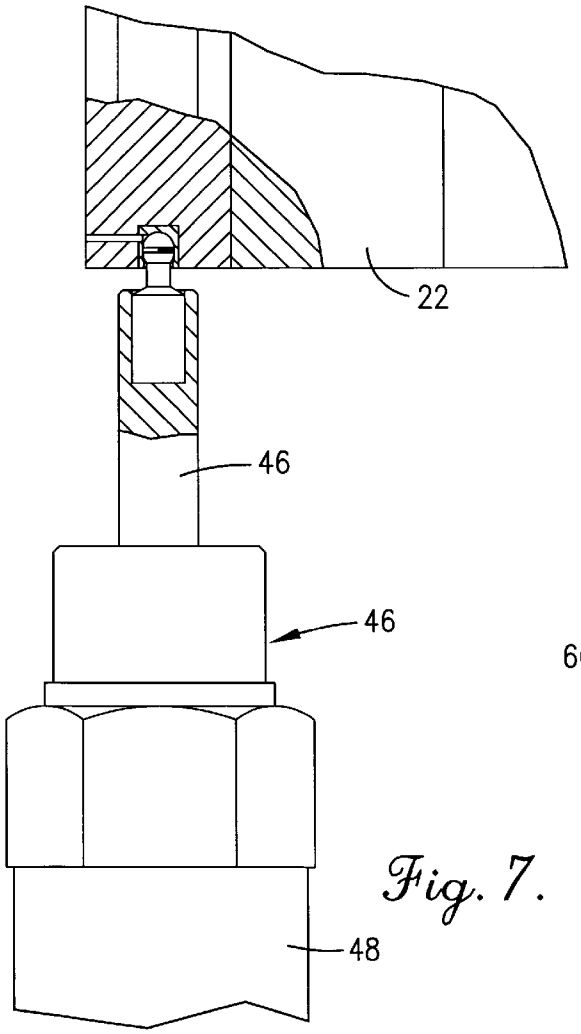
FIG. 7 is a partial, elevational view in partial section taken along line 7—7 of FIG. 3.

Preferred actuator 22 includes left hydraulic cylinder 42 and right hydraulic cylinder 44. As best viewed in FIGS. 3 and 7, shaft 46 of left cylinder 42 is connected to the lower edge of chase 22 adjacent the left side thereof using a ball and socket connection as shown in FIG. 7. The cylinder body 48 is attached to machine body 14 below chase 22. Similarly, the shaft 50 of right cylinder 44 is connected to the lower edge of chase 22 adjacent the right side thereof and the cylinder body 52 is attached to machine body 14 therebelow.

Holding assembly 30 includes registration assembly 54 and locking mechanism 56. Registration assembly 54 includes upper, wedge-shaped, registration tab 60, upper registration slot 62, lower, wedge-shaped, registration tab 64 and lower registration slot 66.

Figure 9:
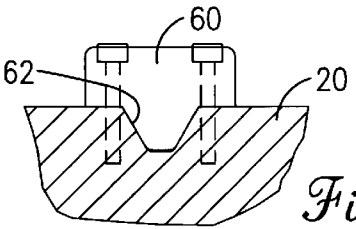
FIG. 9 is a partial sectional view taken along line 9—9 of FIG. 8.

Referring to FIGS. 3 and 8–10, upper tab 60 is connected to the upper edge of chase 22 and extends downwardly adjacent the inboard face thereof. Upper registration slot 62 is defined in the upper edge of platen 20 and is configured to mate with upper tab 60 when chase 22 is in the operating position as best shown in FIG. 9.

Lower registration tab 64 is connected to the lower edge of platen 20 and extends upwardly adjacent the inboard face thereof. Lower registration slot 66 is defined in the lower edge of chase 22 and is configured to mate with lower tab 64 when chase 22 is in the operating position. Tabs 60, 64 and slots 62, 66 are aligned with the vertical centerlines of chase 22 and platen 20.

As chase 22 lowers from the shifted position to the operating position, tabs 60, 64 enter respective slots 62, 66. As they do so, the wedge-shaped configuration causes tabs 60, 64 to align in respective slots 62, 66. This action aligns and registers chase 22 both vertically and horizontally with platen 20 and thereby with machine body 14.

Referring to FIGS. 4 and 11–13, locking mechanism 56 includes hydraulic cylinder 68 connected by drive clevis 70 to drive shaft 72. Mechanism 56 further includes left locking operator 74 and right locking operator 76.

Figure 12:
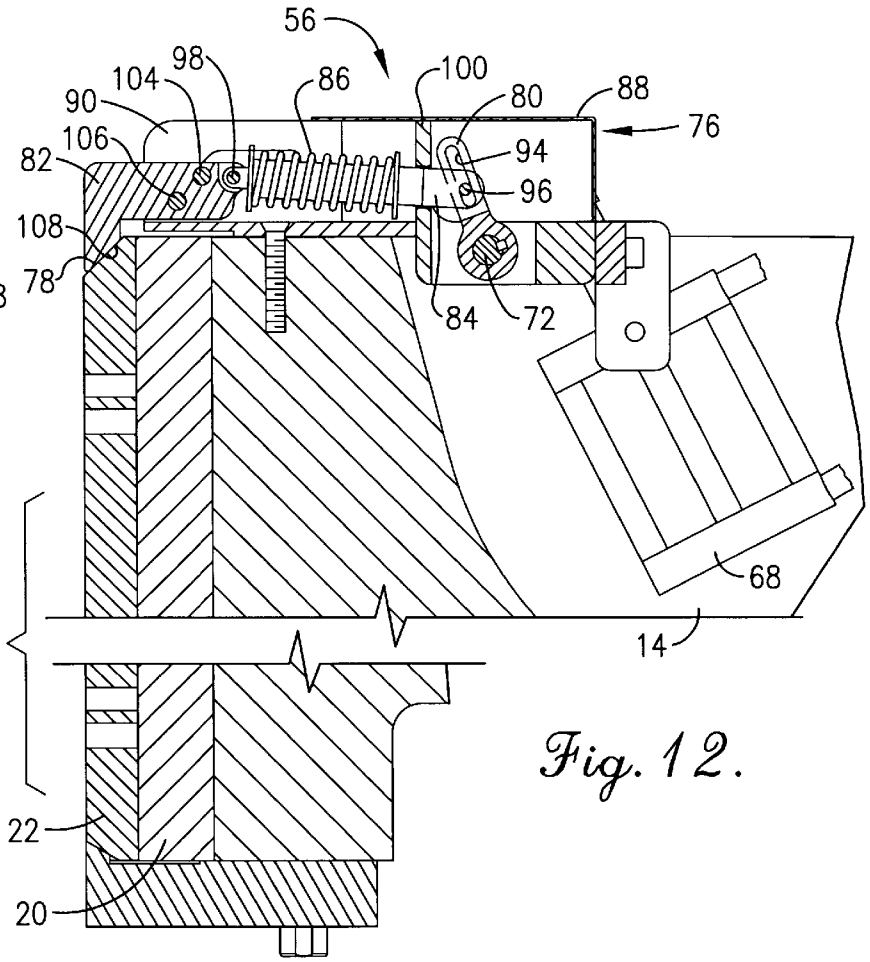
FIG. 12 is a partial elevational view in partial section taken along line 12—12 of FIG. 3 showing the locking mechanism in the locked position.
Figure 11:
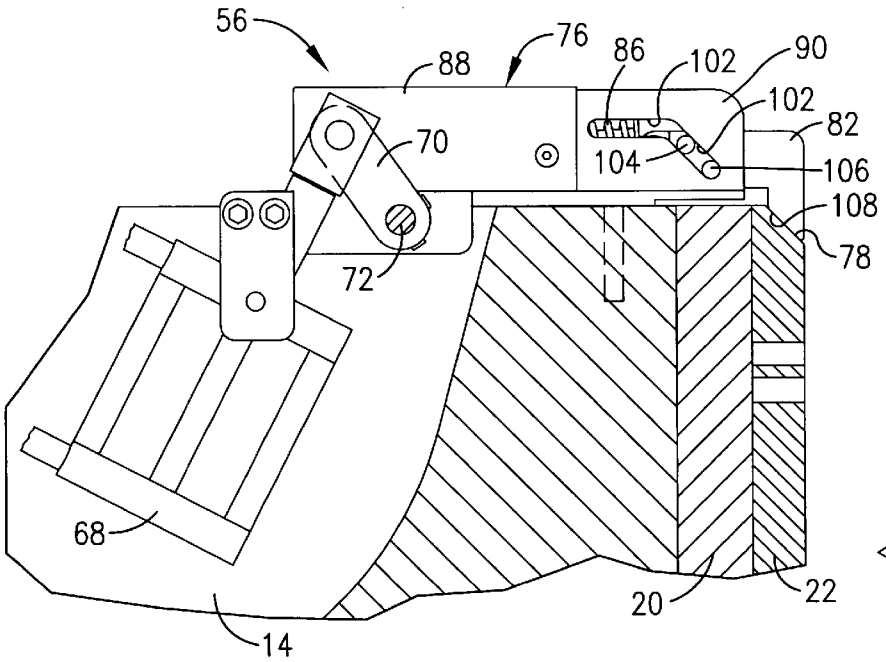
FIG. 11 is a partial elevational view in partial section taken along line 11—11 of FIG. 3 showing the locking mechanism in the released position.
Figure 13:
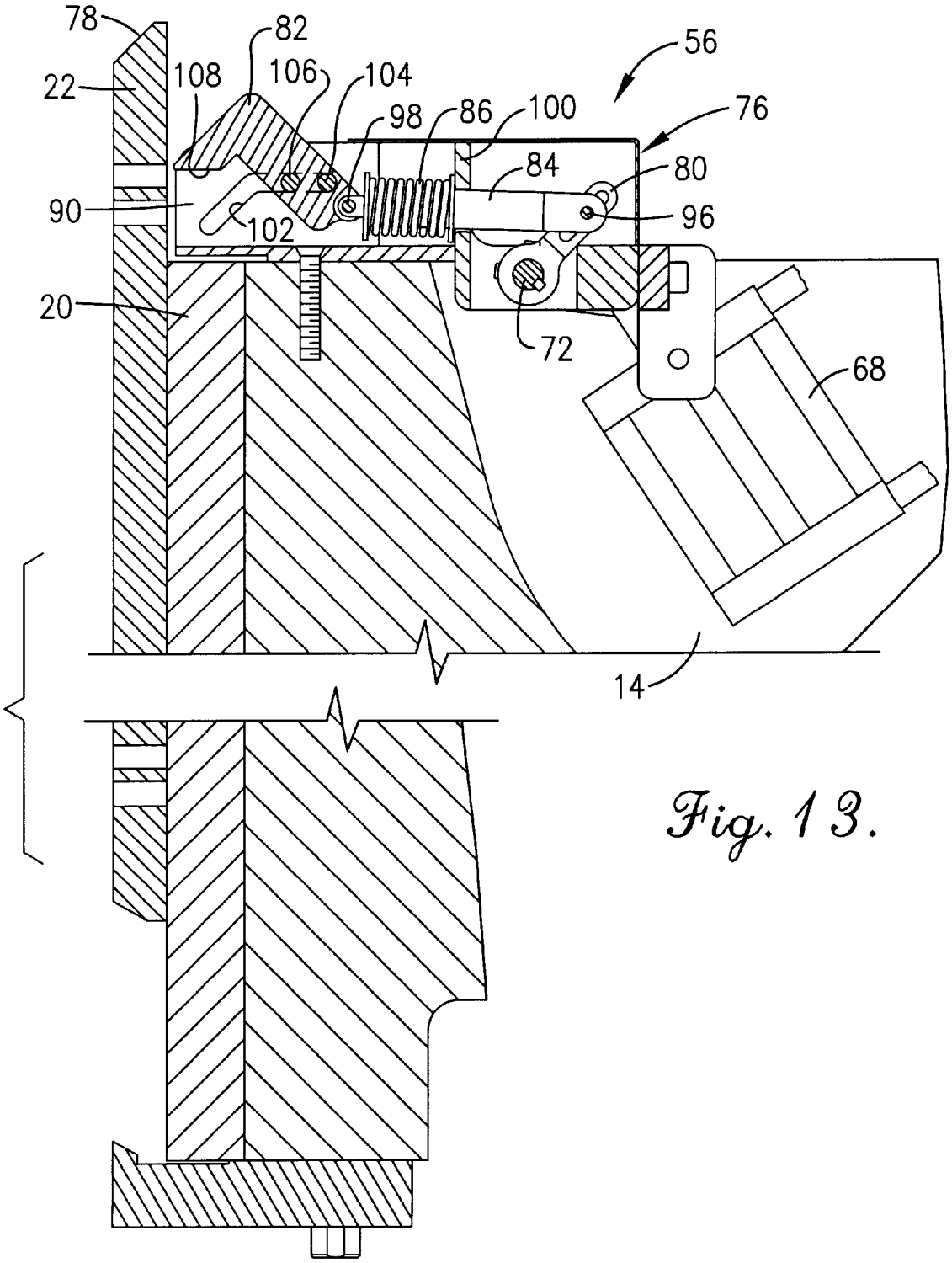
FIG. 13 is a view similar to FIG. 12 but showing the chase in the shifted position and the locking mechanism in the released position.

Drive shaft 72 is rotatably mounted to machine body 14 inboard of platen 20. Actuation of hydraulic cylinder 68 causes rotation of shaft 72. FIGS. 11 and 12 illustrate hydraulic cylinder extended and placing locking mechanism 56 in the locked position thereby locking chase 22 in the operating position. Conversely, FIG. 13 shows hydraulic cylinder retracted placing mechanism 56 in the unlocked or released position with chase 22 in the shifted position.

Left and right locking operators 74 are positioned on either side of the vertical centerline of chase 22 adjacent the upper edge thereof. As shown in FIGS. 11–13, the upper edge of chase 22 presents beveled surfaces 78 in the vicinity of operators 74, 76.

Each operator 74, 76 includes lever yoke 80 keyed and fixed to drive shaft 72 for rotation therewith, L-shaped locking bar 82, link 84 interconnecting yoke 80 and locking bar 82, spring 86, and mounting block 88 having spaced mounting arms 90 and 92. Yoke 80 includes pin slots 94 defined in the arms thereof. One end of link 84 is received between the arms of yoke 80. Coupling pin 96 extends through link 84 with the ends thereof received in pin slots 94 to couple link 84 with yoke 80.

Link pin 98 connects the opposed end of link 84 with the inboard end of locking bar 82. Spring 86 is positioned about link 84 between mounting wall 100 and locking bar 82 in order to bias bar 82 toward the locked position as shown in FIG. 12.

Mounting arms 90, 92 present respective, dog-leg shaped, guide slots 102. Locking bar 82 is received between mounting arms 90, 92. Spaced guide pins 104 and 106 extend through locking bar 82 with the ends thereof received in respective guide slots 102 of mounting arms 90, 92. Each locking bar 82 presents beveled contact surface 108 configured to engage and mate with beveled surface 78 of chase 22.

In the locked position, cylinder 68 is extended and drive shaft 72 is rotated clockwise as viewed in FIG. 11 and counter-clockwise from the view of FIG. 12. In this position, lever yoke 80 is rotated toward chase 22, spring 86 is extended and locking bar 82 reaches over chase 22 with surfaces 78 and 108 in contact. When in the locked position, locking mechanism 56 holds chase 22 in the operating position and registration assembly 54 ensures that chase 22 is in registration.

When press 10 is being used for operations such as converting, die cutting, foil stamping and embossing, chase 22 is in the operating position and locking mechanism 56 is in the locked position. When a tool change or adjustment is needed, the first step is to move or trip the auxiliary safety device and then to shift locking mechanism 56 to the released or unlocked position in order to retract the locking bars 82 of left and right operators 74, 76. Hydraulic cylinder 68 is actuated to retract effect such retraction. This rotates drive shaft 72 counter-clockwise as viewed in FIG. 11 and clockwise from the viewpoint of FIG. 12. During this rotation, the arm of lever yoke 80 rotates inwardly away from chase 22. This action pulls link 84 and locking bar 82 rearwardly.

As locking bar 82 moves rearwardly, guide pins 104 and 106 follow the contour of guide slots 102 thereby causing locking bar 82 to shift upwardly and also away from chase 22. Guide pins 104, 106 continue to follow the contour of guide slots 102 until locking bar 82 is retracted and is no longer positioned above chase 22. This is the released position and chase 22 is free to shift upwardly toward the shifted position as illustrated in FIG. 13.

Left and right lift cylinders 42, 44 are then actuated to extend the chase. This action lifts chase 22 while guide rollers 34 maintain alignment. Tool replacement or adjustment can then take place in a convenient and efficient manner.

When the tooling changeover or adjustment is complete, left and right lift cylinders 42, 44 are actuated to retract. This action lowers chase 22 to the operating position as shown in FIG. 1. As discussed above, registration assembly 54 ensures that chase 22 achieves registration as is shifts into the operating position. Hydraulic cylinder 68 of locking mechanism 56 is then actuated to extend. This shifts mechanism 56 to the locked position and in particular, shifts the locking bars 82 of left and right operators 74, 76 over chase 22 and into locking engagement therewith.

Those skilled in the art will appreciate that the present invention encompasses many variation in the preferred embodiment described herein. For example, the hydraulic cylinders could be replaced with air cylinders, electrically actuated operators, or mechanical devices. In another example, chase 22 could be shifted to the left or right in order to expose it for tool adjustment and changeover. Also, the present invention finds utility with other types of machines in which a chase or plate needs to be shifted from the machine for retooling or other adjustments.

Having thus described the preferred embodiment of the present invention, the following is claimed as new and desired to be secured by Letters Patent:

1. A tool changeover, setup and adjustment apparatus for use with a press having a machine body, said apparatus comprising:

a tool chase adapted to support tools for operation of said press, said chase having an upper edge and a lower edge;

a track assembly configured for shiftably coupling the tool chase with the machine body for selective shifting of the chase relative to the machine body between an operating position in which the chase is positioned relative to the machine body for operations, and a shifted position in which the chase is shifted from the operating position while remaining coupled with the machine body to a location facilitating tool changeover on the chase;

an actuator configured for coupling with the chase for selectively shifting the chase between said operating and said shifted positions; and a holding assembly configured for locating and holding the chase in operating registration with the machine body while in said operating position, said holding assembly including an upper registration slot defined in the machine body adjacent the upper edge of the chase and an upper registration tab coupled with the chase and configured for mated reception and thereby registration in said upper registration slot when the chase is in said operating position, and a lower registration slot defined in the lower edge of the chase and a lower registration tab coupled with the machine body adjacent the lower edge of the chase and configured for mated reception and thereby registration in said lower registration slot when the chase is in said operating position.

2. A clamshell press comprising:

a machine body;

a generally planar tool chase presenting an upper edge and an outer surface to which die-cutting tools may be mounted for operations of the machine, said machine body supporting said tool chase and presenting an upright face having an upper margin, said upright face being adjacent said tool chase with the chase lying in an upright chase plane;

a movable jaw supporting a die plate and shiftable toward and away from said chase for performing operations on a workpiece placed between the body and jaw; and a tool changeover apparatus including a track assembly shiftably coupling the tool chase with the machine body for selective shifting of the chase within said upright chase plane and relative to the machine body between a operating position in which the chase is positioned relative to the machine body substantially adjacent said upright body face and with said chase upper edge closely adjacent said body face upper margin for operations, and a shifted position in which the chase is shifted upwardly from the operating position with a portion of the chase and said chase upper edge located above said upper margin of said upright face while remaining coupled with the machine body to a location facilitating tool changeover on the plate, an actuator coupled with the chase for selectively shifting the chase between said operating and said shifted positions.

3. The press as set forth in claim 2, said changeover apparatus further including a holding assembly configured for locating and holding the chase in operating registration with the machine body while in said operating position.

4. The press as set forth in claim 3, said holding assembly including an upper registration slot defined in the machine body adjacent the upper edge of the chase and an upper registration tab coupled with the chase and configured for mated reception and thereby registration in said upper registration slot when the chase is in said operating position, and a lower registration slot defined in the lower edge of the chase and a lower registration tab coupled with the machine body adjacent the lower edge of the chase and configured for mated reception and thereby registration in said lower registration slot when the chase is in said operating position.

5. The press as set forth in claim 3, said holding assembly further including a locking mechanism coupled with the machine body and shiftable between a locking position for locking the chase in said operating position and a released position allowing shifting of the chase, said locking mechanism including a plurality of locking bars coupled with the machine body adjacent the upper edge of the chase and shiftable between said locked position in which said locking bars are positioned over the upper edge of the chase to lock the chase in the operating position and said released position in which said locking bars are retracted away from the upper edge of the chase, and an hydraulic cylinder and linkage connecting said cylinder with said locking bars for selective shifting of said bars between said locked and released positions.

6. The apparatus as set forth in claim 2, said holding assembly further including a locking mechanism coupled with the machine body and shiftable between a locking position for locking the chase in the operating position and a released position allowing shifting of the chase.

7. The apparatus as set forth in claim 6, said locking mechanism including at least one locking bar coupled with the machine body adjacent the upper edge of the chase and shiftable between said locked position in which said locking bar is positioned over the upper edge of the chase to lock the chase in said operating position and said released position in which the locking bar is retracted away from the upper edge of the chase.

8. The apparatus as set forth in claim 7, said locking mechanism further including a pair of said locking bars.

9. The apparatus as set forth in claim 8, said locking mechanism further including an hydraulic cylinder and linkage connecting said cylinder with said locking bars for shifting said bars between said locked and released positions.

10. The apparatus as set forth in claim 1, the chase including opposed side edges, said track assembly including structure defining respective guide tracks in the side edges of the chase, and a plurality of rollers having respective shafts coupled with the machine body with the rollers rollably received in said guide tracks.

11. The apparatus as set forth in claim 10, said rollers and shafts being positioned for enabling shifting of the chase in the plane thereof between said operating and shifted positions.

12. The apparatus as set forth in claim 1, said press including a clamshell press, said track assembly being configured for enabling shifting of the chase in a generally up and down orientation.

13. The apparatus as set forth in claim 1 further including a plurality of actuators.

14. The apparatus as set forth in claim 1, said actuator including an hydraulic cylinder.

15. The apparatus as set forth in claim 1, said actuator including a pair of hydraulic cylinders.

16. The apparatus as set forth in claim 15, the chase having a lower edge, said cylinders being coupled with the lower edge of the chase.

* * * * *